US011738930B2

(12) United States Patent
Wang et al.

(10) Patent No.: US 11,738,930 B2
(45) Date of Patent: Aug. 29, 2023

(54) CUSHION PACKAGE BOX AND ELECTRONIC PRODUCT CUSHION PACKAGE ASSEMBLY

(71) Applicant: Wistron Corporation, New Taipei (TW)

(72) Inventors: Kuo-Shen Wang, New Taipei (TW); Shixiong Wen, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 17/857,153

(22) Filed: Jul. 4, 2022

(65) Prior Publication Data

US 2023/0069609 A1 Mar. 2, 2023

(30) Foreign Application Priority Data

Aug. 24, 2021 (CN) ..... 202122009485.9

(51) Int. Cl.
*B65D 81/107* (2006.01)
*B65D 81/133* (2006.01)
*B65D 85/68* (2006.01)

(52) U.S. Cl.
CPC ..... *B65D 81/133* (2013.01); *B65D 81/107* (2013.01); *B65D 85/68* (2013.01); *B65D 2581/053* (2013.01); *B65D 2585/86* (2013.01)

(58) Field of Classification Search
CPC ..... B65D 81/107; B65D 2581/053; B65D 2585/86
USPC ..... 206/591, 594
See application file for complete search history.

(56) References Cited

U.S. PATENT DOCUMENTS

| | | | | |
|---|---|---|---|---|
| 4,836,379 | A * | 6/1989 | Shaw | B65D 81/107 206/453 |
| 5,462,171 | A * | 10/1995 | Moog | B65D 81/113 428/116 |
| 7,871,363 | B1 * | 1/2011 | Branyon | B65D 5/5047 493/287 |
| 2008/0128317 | A1 * | 6/2008 | Tsukada | B65D 81/107 206/594 |
| 2013/0277418 | A1 * | 10/2013 | Van Berlo | B65D 81/02 229/87.02 |
| 2020/0216252 | A1 * | 7/2020 | Laguna | B65D 81/127 |
| 2022/0250827 | A1 * | 8/2022 | Smith | B65B 5/028 |

* cited by examiner

*Primary Examiner* — Jacob K Ackun
(74) *Attorney, Agent, or Firm* — Winston Hsu

(57) ABSTRACT

A cushion package box includes a box body, a first cushion member and at least one paper tube. The first cushion member is disposed in the box body and has a porous structure. An opening direction of the porous structure is different from an opening direction of the at least one paper tube. The at least one paper tube is disposed in the box body and in contact with the first cushion member.

20 Claims, 14 Drawing Sheets

CUSHION PACKAGE BOX AND ELECTRONIC PRODUCT CUSHION PACKAGE ASSEMBLY

BACKGROUND OF THE DISCLOSURE

1. Field of the Disclosure

The disclosure relates to a cushion package box and an electronic product cushion package assembly and, more particularly, to a cushion package box and an electronic product cushion package assembly capable of reducing assembly materials and improving assembly efficiency.

2. Description of the Prior Art

In general, a product will be packed in a package box when shipped to prevent the product from being damaged due to impact during transportation. In order to match the external dimensions of the product, the cushion components in the package box are designed by a multi-piece structure, thereby improving the protection ability of the cushion material to the product. For the product with large size and heavy weight, the compression coefficient should be calculated according to different sizes and different weights, such that the package design requires more cushion components to achieve the required compression coefficient during transportation. Since the structural design is complicated and too many cushion components needs to be assembled, the manual assembly operation is complicated, such that it is easy to cause problems such as improper assembly and lack of components. Furthermore, due to cost and environmental factors, the conventional cushion components are mostly made of molded pulp and/or corrugated paper. The recovery ability of molded pulp and corrugated paper after drop test is not good, the molded pulp is easily affected by environmental humidity, and the corrugated paper has many parts and complicated structure.

SUMMARY OF THE DISCLOSURE

The disclosure provides a cushion package box and an electronic product cushion package assembly capable of reducing assembly materials and improving assembly efficiency, so as to solve the aforesaid problems.

According to an embodiment of the disclosure, a cushion package box comprises a box body, a first cushion member and at least one paper tube. The first cushion member is disposed in the box body and has a porous structure. An opening direction of the porous structure is different from an opening direction of the at least one paper tube. The at least one paper tube is disposed in the box body and in contact with the first cushion member.

According to another embodiment of the disclosure, an electronic product cushion package assembly comprises a cushion package box and an electronic product. The cushion package box comprises a box body, a first cushion member and at least one paper tube. The first cushion member is disposed in the box body and has a porous structure. An opening direction of the porous structure is different from an opening direction of the at least one paper tube. The at least one paper tube is disposed in the box body and in contact with the first cushion member. The electronic product is disposed in the box body. The at least one paper tube surrounds the electronic product.

As mentioned in the above, the disclosure replaces the molded pulp and/or the corrugated paper of the prior art by the first cushion member with the porous structure and the paper tube, so as to reduce assembly materials of the cushion package box, reduce assembly cost, and improve assembly efficiency. Since the structure of the cushion package box is simplified, the disclosure can effectively avoid the problems such as improper assembly and lack of components due to manual assembly operation. Furthermore, the cushion abilities of the first cushion member with the porous structure and the paper tube are good, such that the disclosure can effectively improve the protection to the product. Moreover, the material characteristics of the first cushion member with the porous structure and the paper tube may reduce the cushion distance, such that the whole volume of the cushion package box may be further reduced, so as to increase the packing capacity of the cushion package box and reduce the transportation cost. In practical applications, the cushion package box of the disclosure may be used to pack an object (e.g. electronic product) to form the electronic product cushion package assembly.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
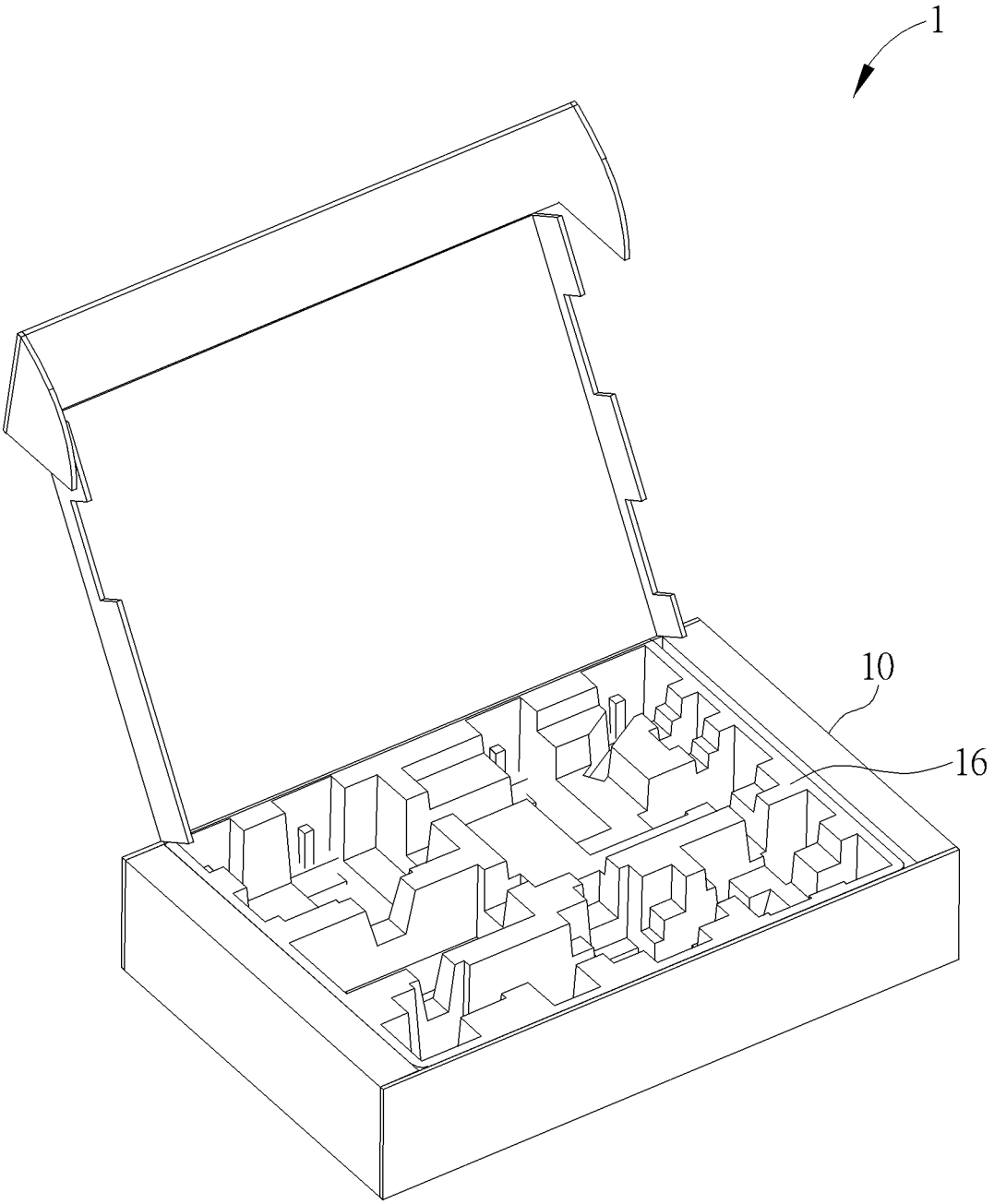
FIG. 1 is a perspective view illustrating a cushion package box according to an embodiment of the disclosure.
Figure 2:
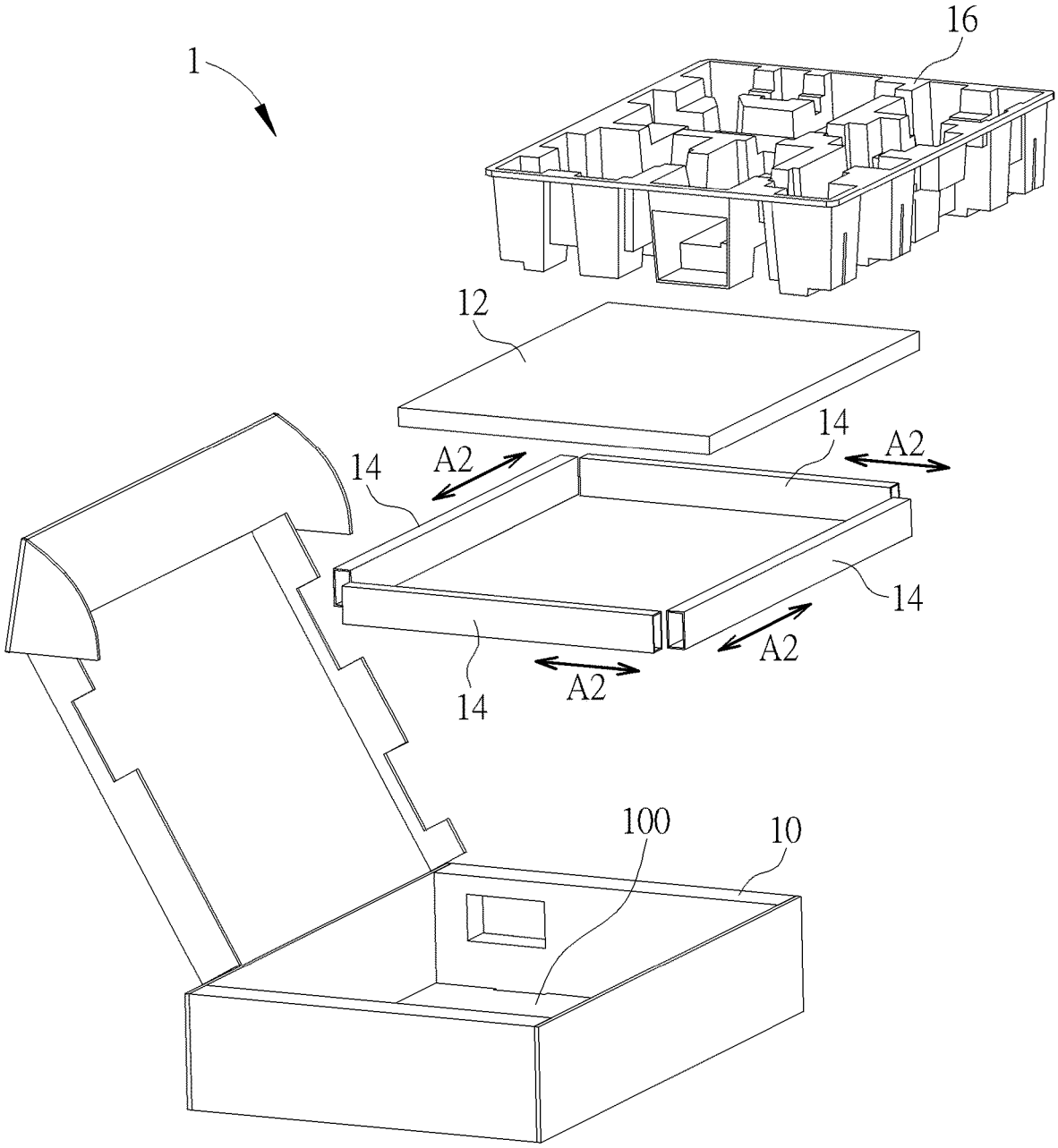
FIG. 2 is an exploded view illustrating the cushion package box shown in FIG. 1.
Figure 3:
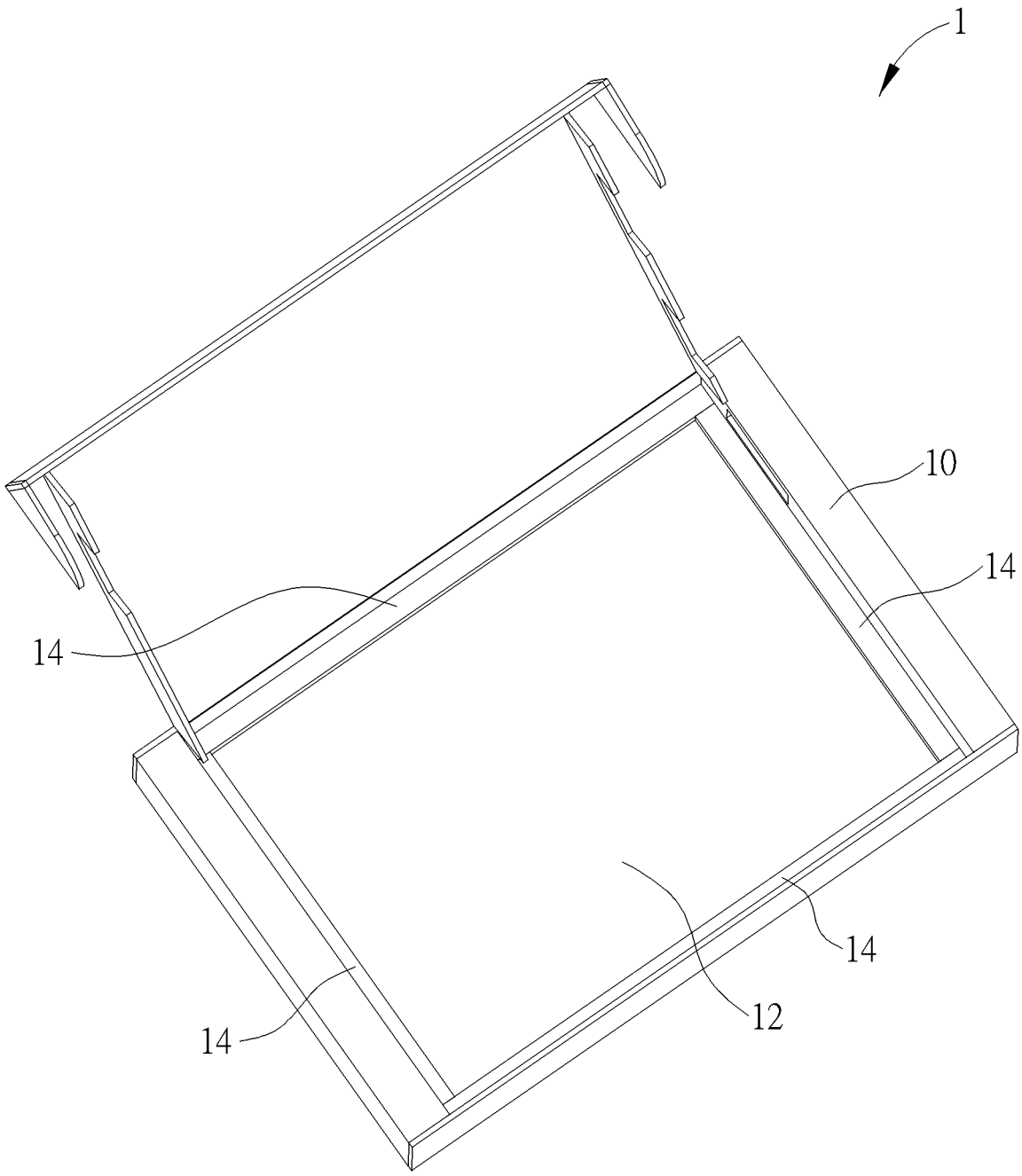
FIG. 3 is a perspective view illustrating the first cushion member and the paper tubes shown in FIG. 2 being disposed in the box body.
Figure 4:
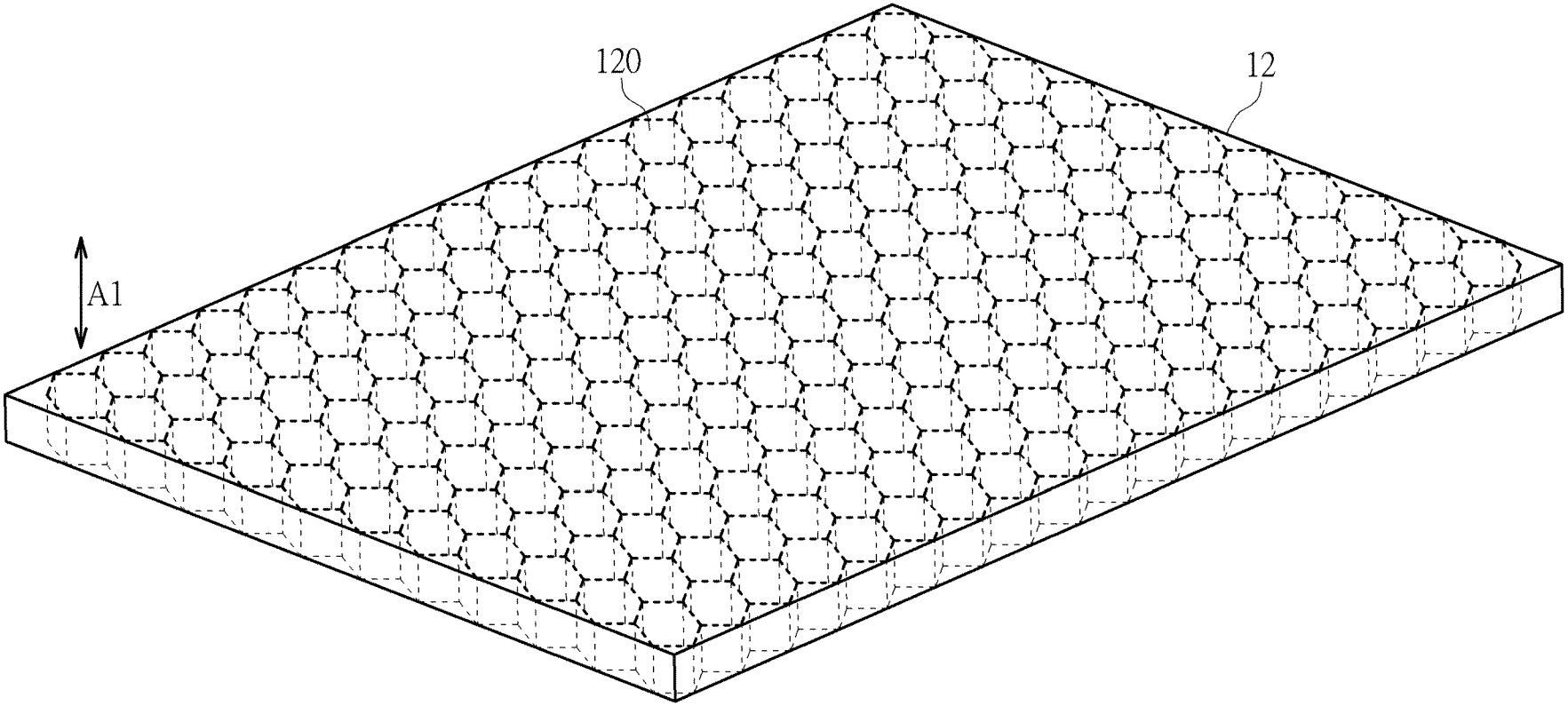
FIG. 4 is a perspective view illustrating the first cushion member shown in FIG. 2.

Referring to FIGS. 1 to 4, FIG. 1 is a perspective view illustrating a cushion package box 1 according to an embodiment of the disclosure, FIG. 2 is an exploded view illustrating the cushion package box 1 shown in FIG. 1, FIG. 3 is a perspective view illustrating the first cushion member 12 and the paper tubes 14 shown in FIG. 2 being disposed in the box body 10, and FIG. 4 is a perspective view illustrating the first cushion member 12 shown in FIG. 2.

As shown in FIGS. 1 to 4, the cushion package box 1 comprises a box body 10, a first cushion member 12, at least one paper tube 14 and a second cushion member 16. In this embodiment, the number of the at least one paper tube 14 is four and the four paper tubes 14 are strip-shaped. The first cushion member 12, the paper tubes 14 and the second cushion member 16 are disposed in the box body 10, wherein the paper tubes 14 are in contact with the first cushion member 12. When assembling the cushion package box 1, the first cushion member 12 and the four paper tubes 14 may be placed into the box body 10 first, such that the four paper tubes 14 are arranged to form a rectangle and surrounds the first cushion member 12, as shown in FIG. 3. Then, the second cushion member 16 is placed into the box body 10, such that the second cushion member 16 is located above the first cushion member 12. When the cushion package box 1 is used to pack an object (e.g. electronic product), the object is sandwiched in between the second cushion member 16, the first cushion member 12 and the paper tubes 14, and the paper tubes 14 surround the object to provide cushion protection for the object.

In another embodiment, the first cushion member 12 may be disposed on the bottom of the box body 10 first and then the paper tubes 14 are disposed on the first cushion member 12. Accordingly, the paper tubes 14 may selectively surround the first cushion member 12 or be disposed on the first cushion member 12 according to practical requirements.

As shown in FIG. 4, the first cushion member 12 has a porous structure 120. In this embodiment, the first cushion member 12 may be a honeycomb board, i.e. the porous structure 120 is honeycomb-shaped. For further explanation, the honeycomb board may comprise two paper plates and a plurality of paper tubes disposed between the two paper plates, wherein the openings of the paper tubes are perpendicular to the two paper plates.

Furthermore, an opening direction A1 of the porous structure 120 is different from an opening direction A2 of the paper tube 14. When the first cushion member 12 is disposed in the box body 10, the opening direction A1 of the porous structure 120 is perpendicular to a bottom surface 100 of the box body 10 (as shown in FIG. 2). It should be noted that the height of the porous structure 120 may be adjusted according to the object to be packed. As shown in FIG. 2, a cross section of a tube body of the paper tube 14 may be rectangular. In this embodiment, the paper tube 14 may be made of a spool paper. When the paper tube 14 is disposed in the box body 10, the opening direction A2 of the paper tube 14 is parallel to the bottom surface 100 of the box body 10. Thus, the opening direction A1 of the porous structure 120 of the first cushion member 12 is perpendicular to the opening direction A2 of the paper tube 14.

By means of the cooperation between the first cushion member 12 with the porous structure 120 and the paper tube 14, the disclosure can effectively increase the cushion effect and the compression coefficient for the object during transportation. The disclosure replaces the molded pulp and/or the corrugated paper of the prior art by the first cushion member 12 with the porous structure 120 and the paper tube 14, so as to reduce assembly materials of the cushion package box 1, reduce assembly cost, and improve assembly efficiency. Since the structure of the cushion package box 1 is simplified, the disclosure can effectively avoid the problems such as improper assembly and lack of components due to manual assembly operation.

In this embodiment, the second cushion member 16 may be a molded pulp pad, such that a lower surface of the second cushion member 16 may be formed into a corresponding shape (e.g. an arc or other regular/irregular shapes) according to the appearance of the object to be packaged, so as to better fit the object and further provide a better cushion effect.

Figure 5:
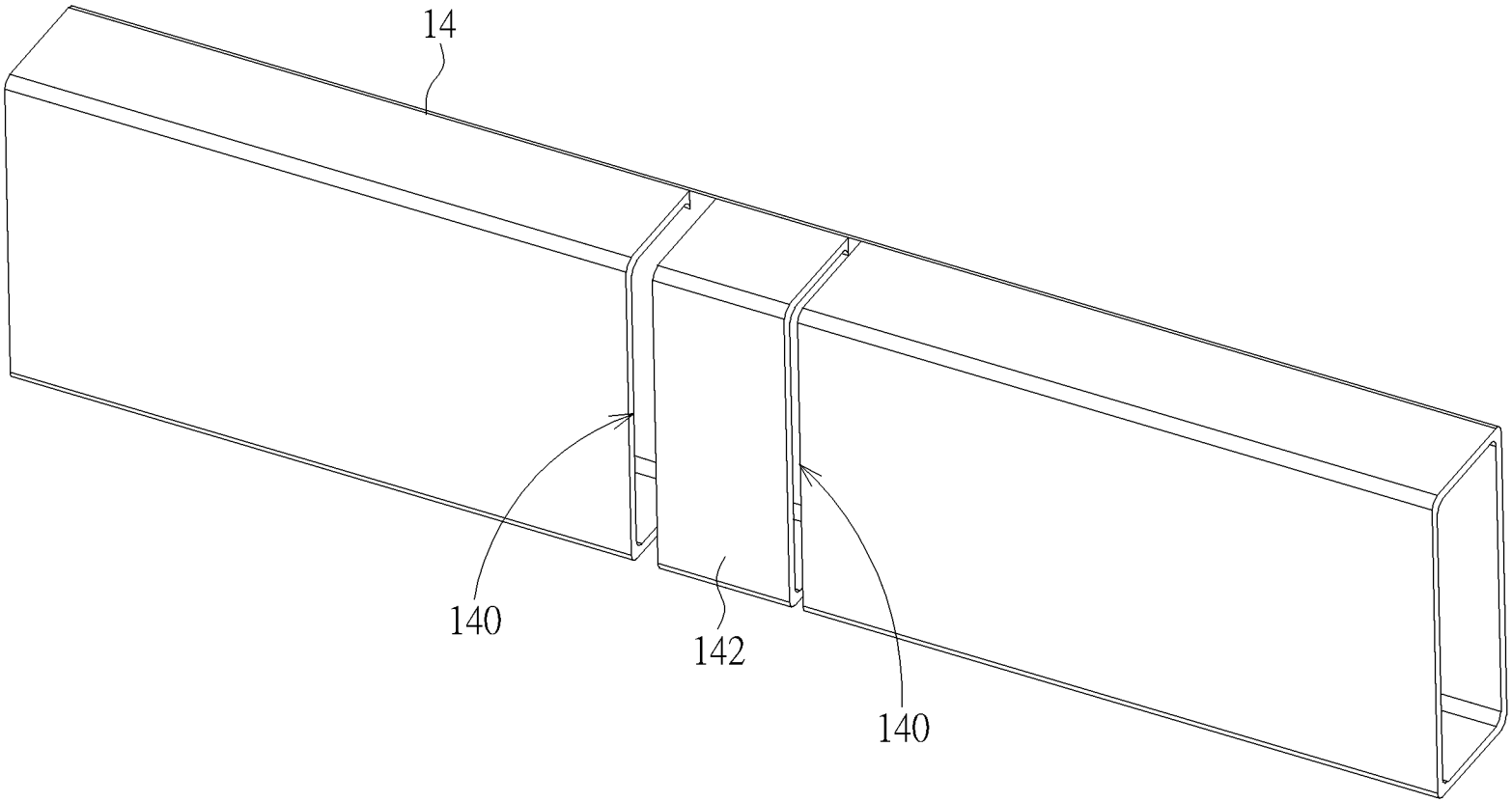
FIG. 5 is a perspective view illustrating a paper tube according to another embodiment of the disclosure.
Figure 6:
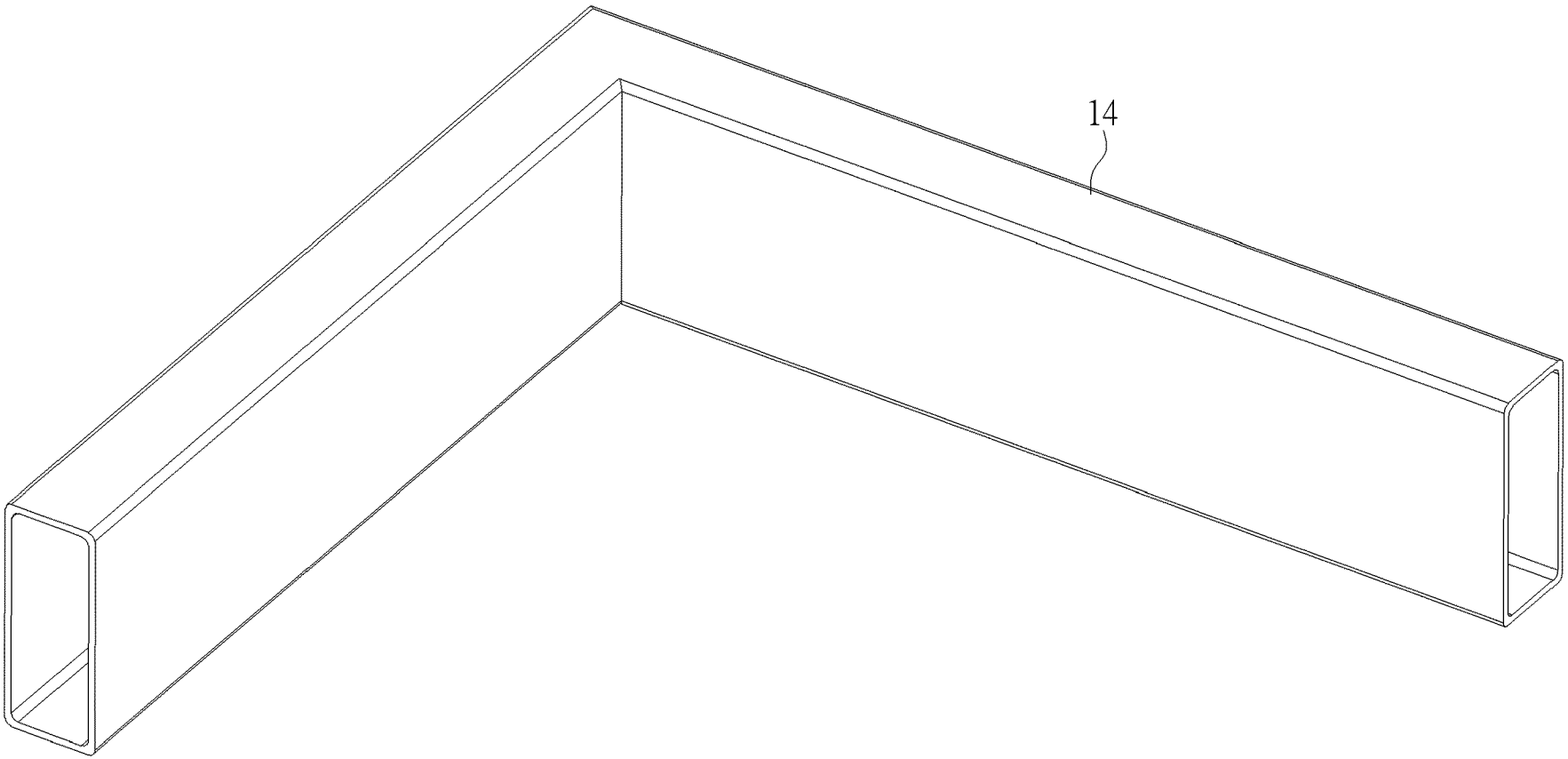
FIG. 6 is a perspective view illustrating the paper tube shown in FIG. 5 being bent to be L-shaped.

Referring to FIGS. 5 and 6, FIG. 5 is a perspective view illustrating a paper tube 14 according to another embodiment of the disclosure, and FIG. 6 is a perspective view illustrating the paper tube 14 shown in FIG. 5 being bent to be L-shaped.

As shown in FIG. 5, a tube body of the paper tube 14 has two cutting grooves 140 and a reinforcing portion 142, wherein the reinforcing portion 142 is located between the two cutting grooves 140. When the tube body of the paper tube 14 is bent to be L-shaped shown in FIG. 6, the reinforcing portion 142 is retracted into the tube body of the paper tube 14 from one of the two cutting grooves 140, such that the reinforcing portion 142 is located in the tube body of the paper tube 14, so as to reinforce the structural strength of the paper tube 14. Accordingly, the number of the at least one paper tube 14 of the disclosure may be two, i.e. the aforesaid cushion package box 1 may comprise two paper tubes 14 shown in FIG. 5, wherein the two paper tubes 14 are bent to be L-shaped, such that the two paper tubes 14 may be arranged to form a rectangle to surround the first cushion member 12 shown in FIG. 2 or be disposed on the first cushion member 12.

In another embodiment, one of two paper tubes may be bent to be U-shaped through the structure shown in FIG. 5, and the other one of the two paper tubes may be strip-shaped shown in FIG. 2, such that the two paper tubes may be arranged to form a rectangle to surround the first cushion member 12 shown in FIG. 2 or be disposed on the first cushion member 12.

In another embodiment, the number of the at least one paper tube 14 of the disclosure may be one and the paper tube 14 may be bent to form a rectangle through the structure shown in FIG. 5, so as to surround the first cushion member 12 shown in FIG. 2 or be disposed on the first cushion member 12. For further explanation, every two adjacent paper tubes 14 may be connected by the cutting groove 140 and the reinforcing portion 142 to form one single paper tune.

Figure 7:
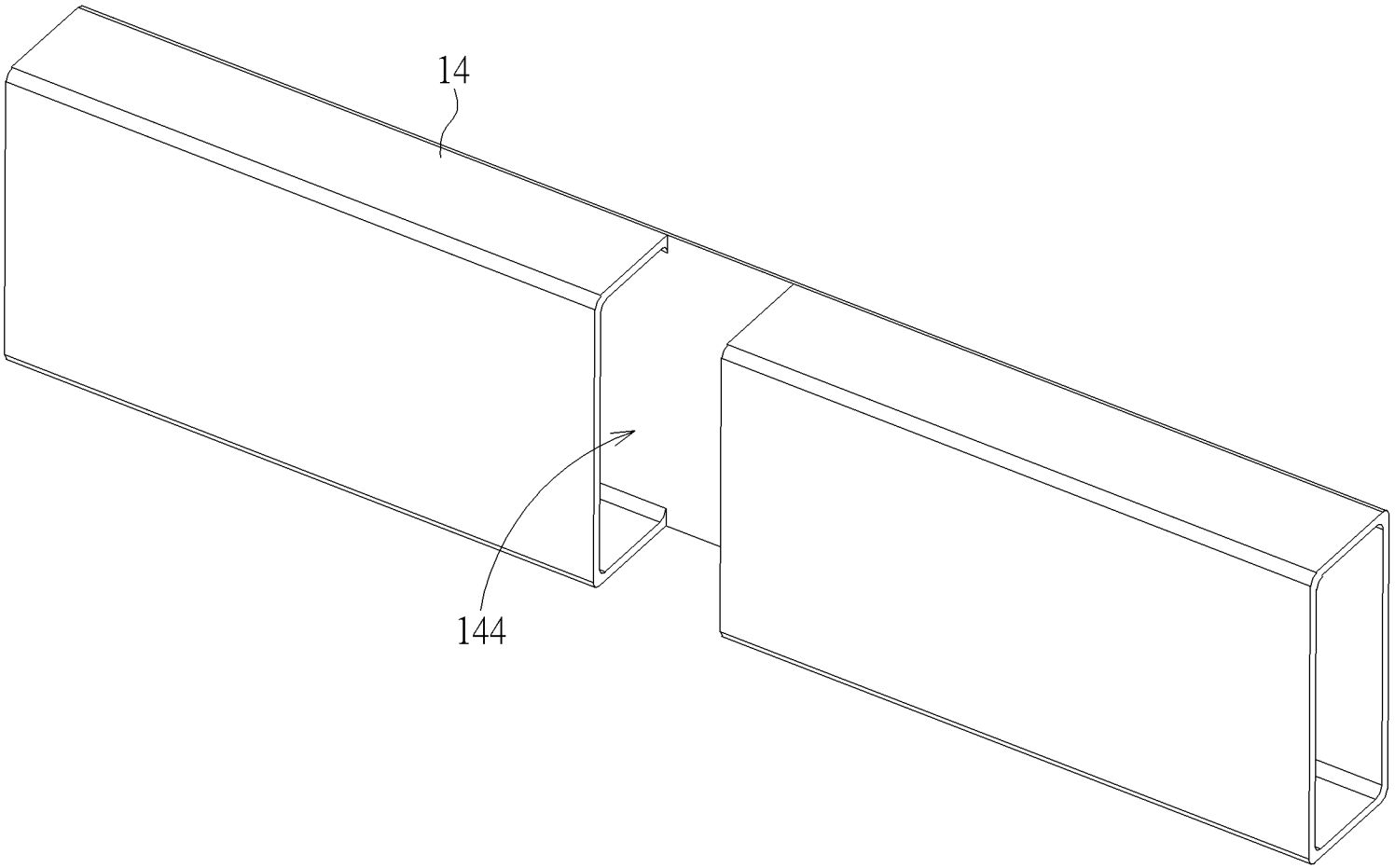
FIG. 7 is a perspective view illustrating a paper tube according to another embodiment of the disclosure.

Referring to FIG. 7, FIG. 7 is a perspective view illustrating a paper tube 14 according to another embodiment of the disclosure. As shown in FIG. 7, a tube body of the paper tube 14 has a slot 144, such that the tube body of the paper tube 14 is able to be bent along the slot 144 by 90 degrees to be L-shaped shown in FIG. 6. Needless to say, the tube body of the paper tube 14 may also have two or three slots 144, such that the tube body of the paper tube 14 is able to bent along the slots 144 to be U-shaped or rectangular.

Figure 8:
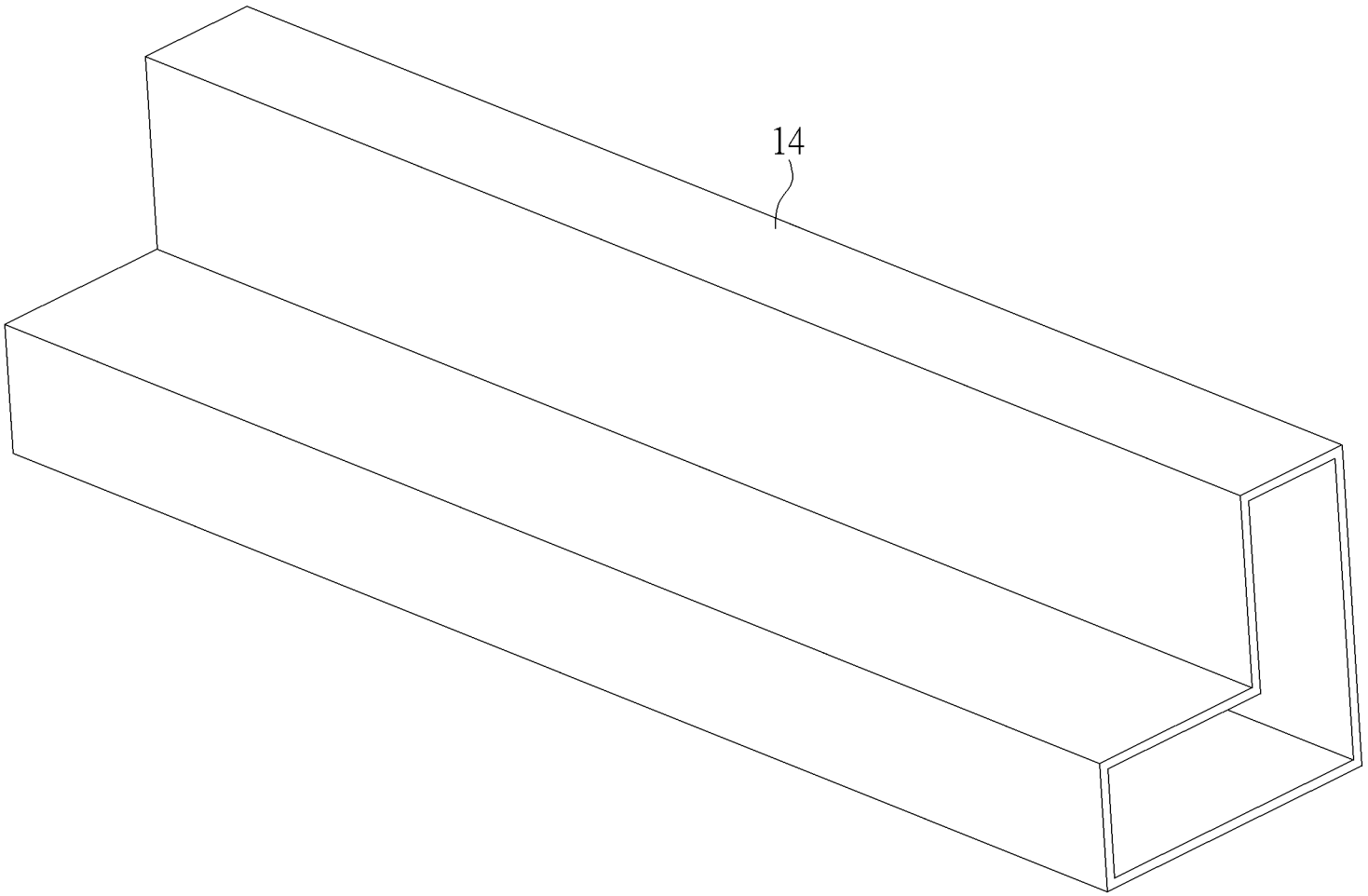
FIG. 8 is a perspective view illustrating a paper tube according to another embodiment of the disclosure.
Figure 9:
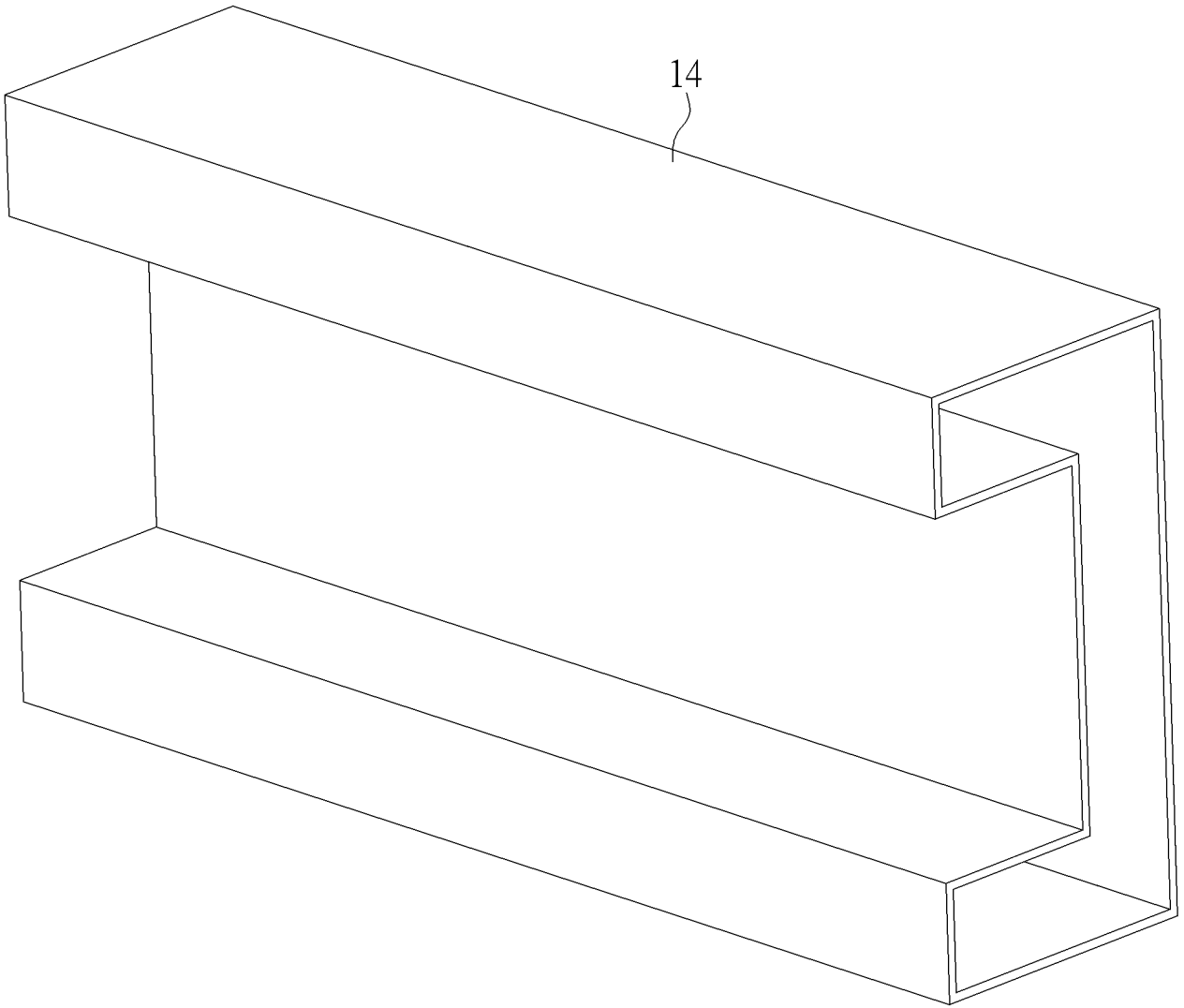
FIG. 9 is a perspective view illustrating a paper tube according to another embodiment of the disclosure.

Referring to FIGS. 8 and 9, FIG. 8 is a perspective view illustrating a paper tube 14 according to another embodiment of the disclosure, and FIG. 9 is a perspective view illustrating a paper tube 14 according to another embodiment of the disclosure. In addition to the rectangular cross section shown in FIG. 2, the cross section of the tube body of the paper tube 14 may also be L-shaped or U-shaped (as shown in FIGS. 8 and 9) to meet the package requirements of different objects.

Figure 10:
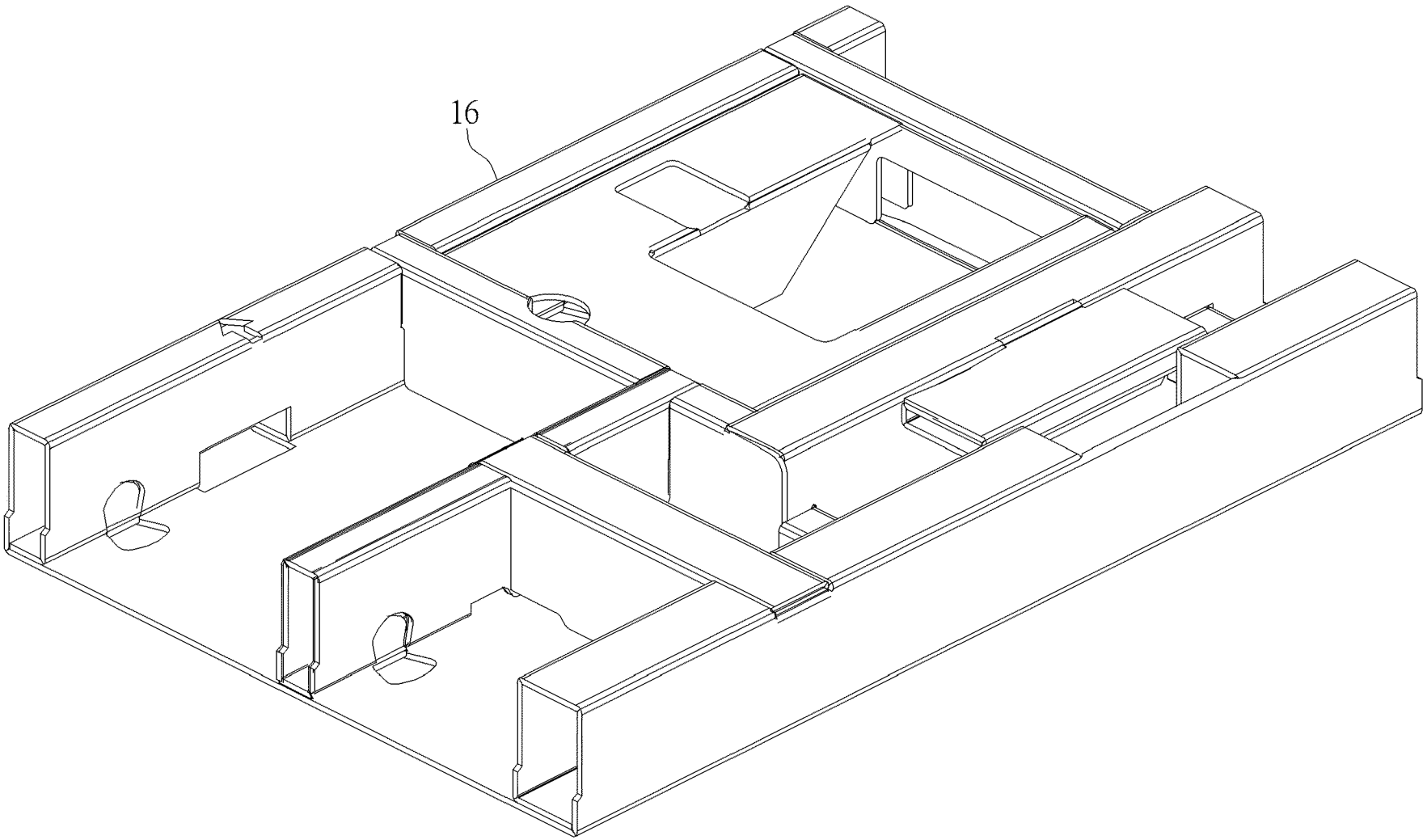
FIG. 10 is a perspective view illustrating a second cushion member according to another embodiment of the disclosure.

Referring to FIG. 10, FIG. 10 is a perspective view illustrating a second cushion member 16 according to another embodiment of the disclosure. In addition to the molded pulp pad shown in FIG. 2, the second cushion member 16 may also be a corrugated paper pad (as shown in FIG. 10) to meet the package requirements of different objects. Furthermore, the second cushion member 16 may also be a honeycomb board shown in FIG. 4 according to practical applications.

It should be noted that some objects do not need the second cushion member 16 to provide cushion effect when packing. At this time, the second cushion member 16 may be omitted from the aforesaid cushion package box 1, i.e. the aforesaid cushion package box 1 may only comprise the box body 10, the first cushion member 12 and the paper tube 14.

Figure 11:
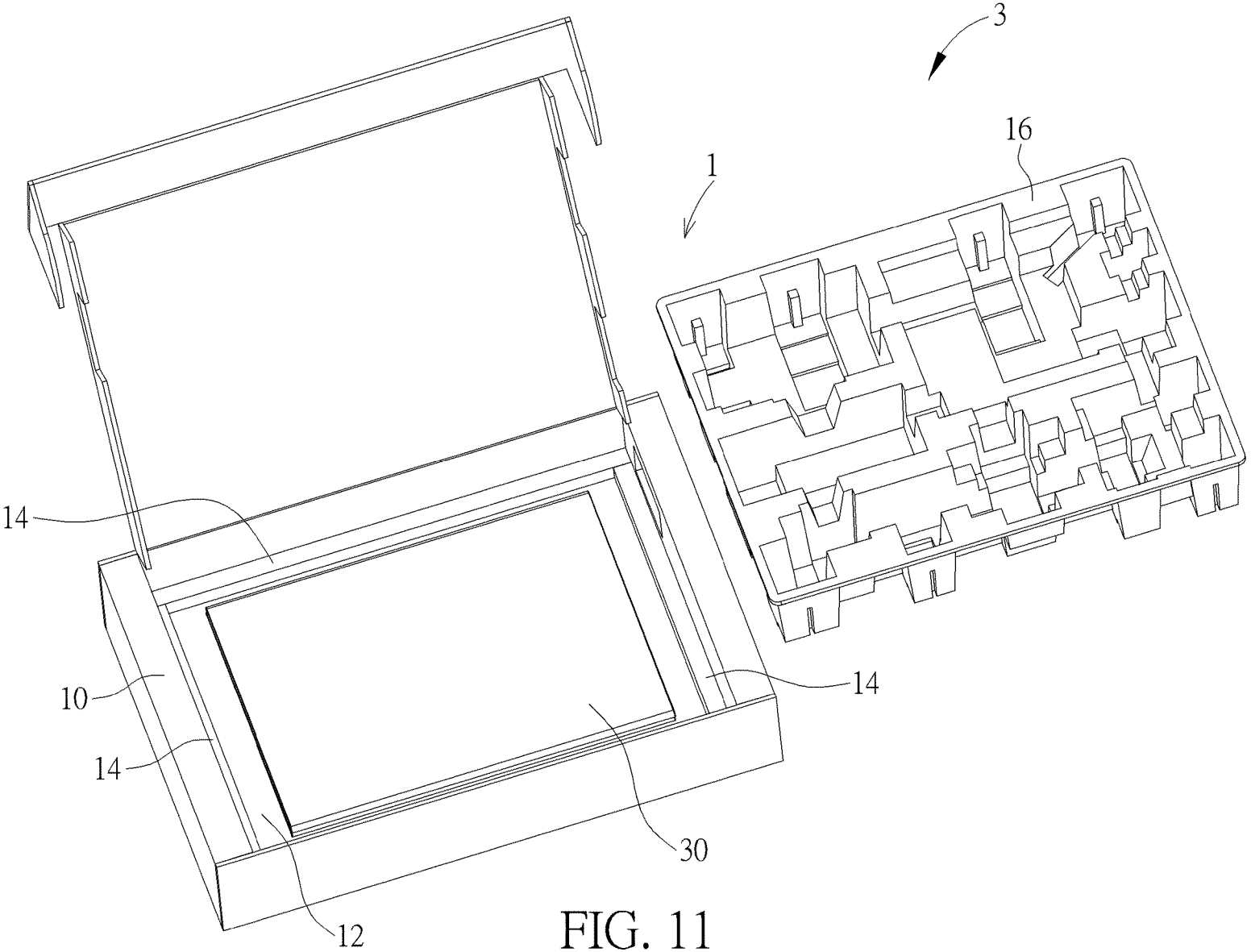
FIG. 11 is a perspective view illustrating an electronic product cushion package assembly according to an embodiment of the disclosure.

Referring to FIG. 11, FIG. 11 is a perspective view illustrating an electronic product cushion package assembly 3 according to an embodiment of the disclosure, wherein the second cushion member 16 is removed from the box body 10 to expose an electronic product 30. As shown in FIG. 11, the electronic product cushion package assembly 3 comprises the aforesaid cushion package box 1 and an electronic product 30. For further explanation, the object packed by the cushion package box 1 may be the electronic product 30 (e.g. display device, notebook computer, tablet computer, television, all-in-one device, and so on). When the object packed by the cushion package box 1 is the electronic product 30, the electronic product 30 is sandwiched in between the second cushion member 16, the first cushion member 12 and the paper tubes 14, and the paper tubes 14 surround the electronic product 30, so as to provide cushion protection for the electronic product 30.

Figure 12:
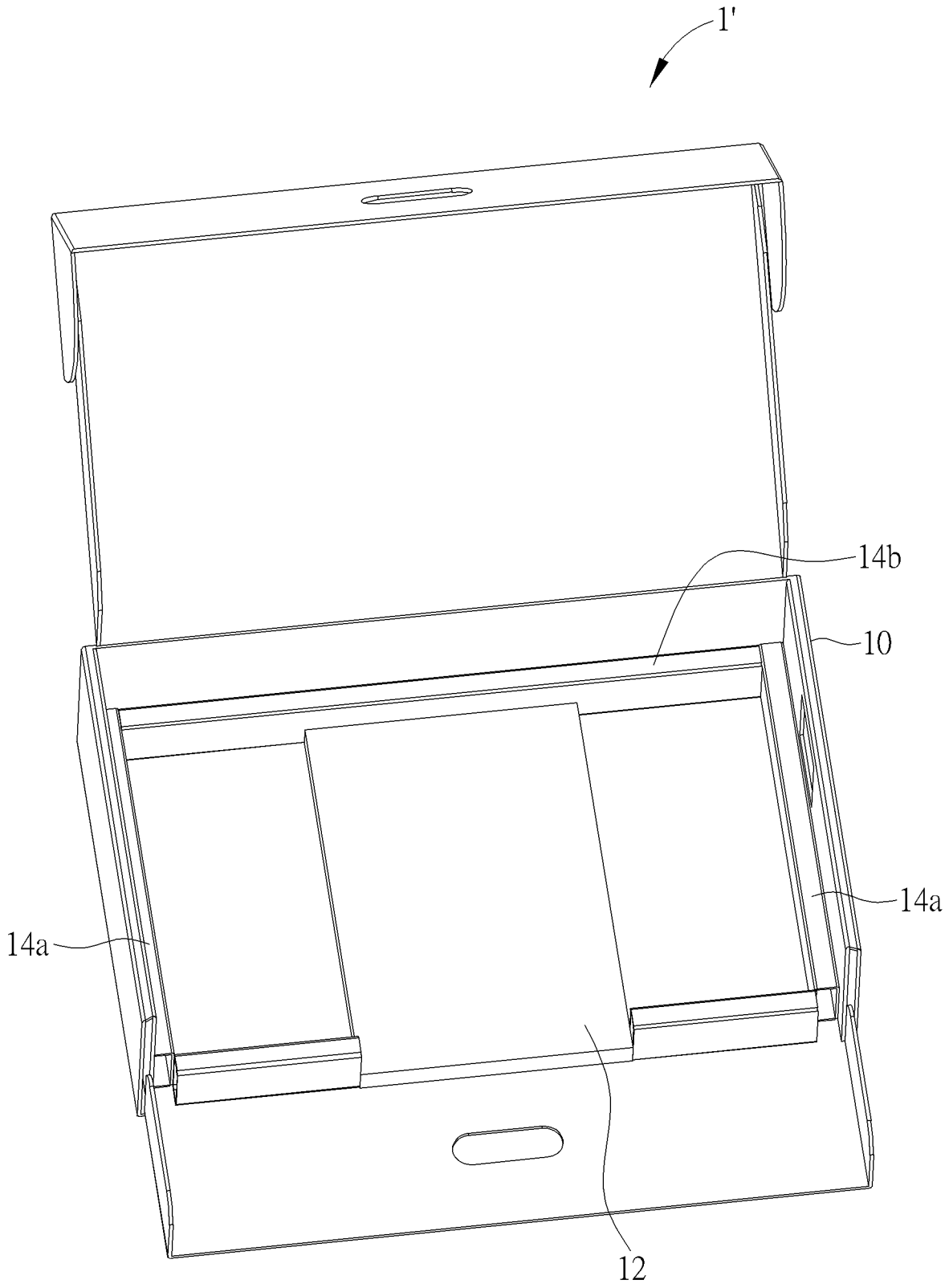
FIG. 12 is a perspective view illustrating a cushion package box according to another embodiment of the disclosure.

Referring to FIG. 12, FIG. 12 is a perspective view illustrating a cushion package box 1' according to another embodiment of the disclosure. As shown in FIG. 12, the at least one paper tube of the cushion package box 1' comprises two L-shaped paper tubes 14*a* and a strip-shaped paper tube 14*b*. Each of the two L-shaped paper tubes 14*a* may be formed by bending a strip-shaped paper tube along a slot (like the slot 144 shown in FIG. 7) by 90 degrees. The two L-shaped paper tubes 14*a* are located at opposite sides of the box body 10, and opposite ends of the strip-shaped paper tube 14*b* respectively abut against the two L-shaped paper tubes 14*a*. As shown in FIG. 12, an edge (e.g. upper edge) of the first cushion member 12 abuts against the strip-shaped paper tube 14*b*, and another edge (e.g. lower edge) of the first cushion member 12 is sandwiched in between two ends of the two L-shaped paper tubes 14*a*. Accordingly, the first cushion member 12 can be positioned in the box body 10 stably.

Figure 13:
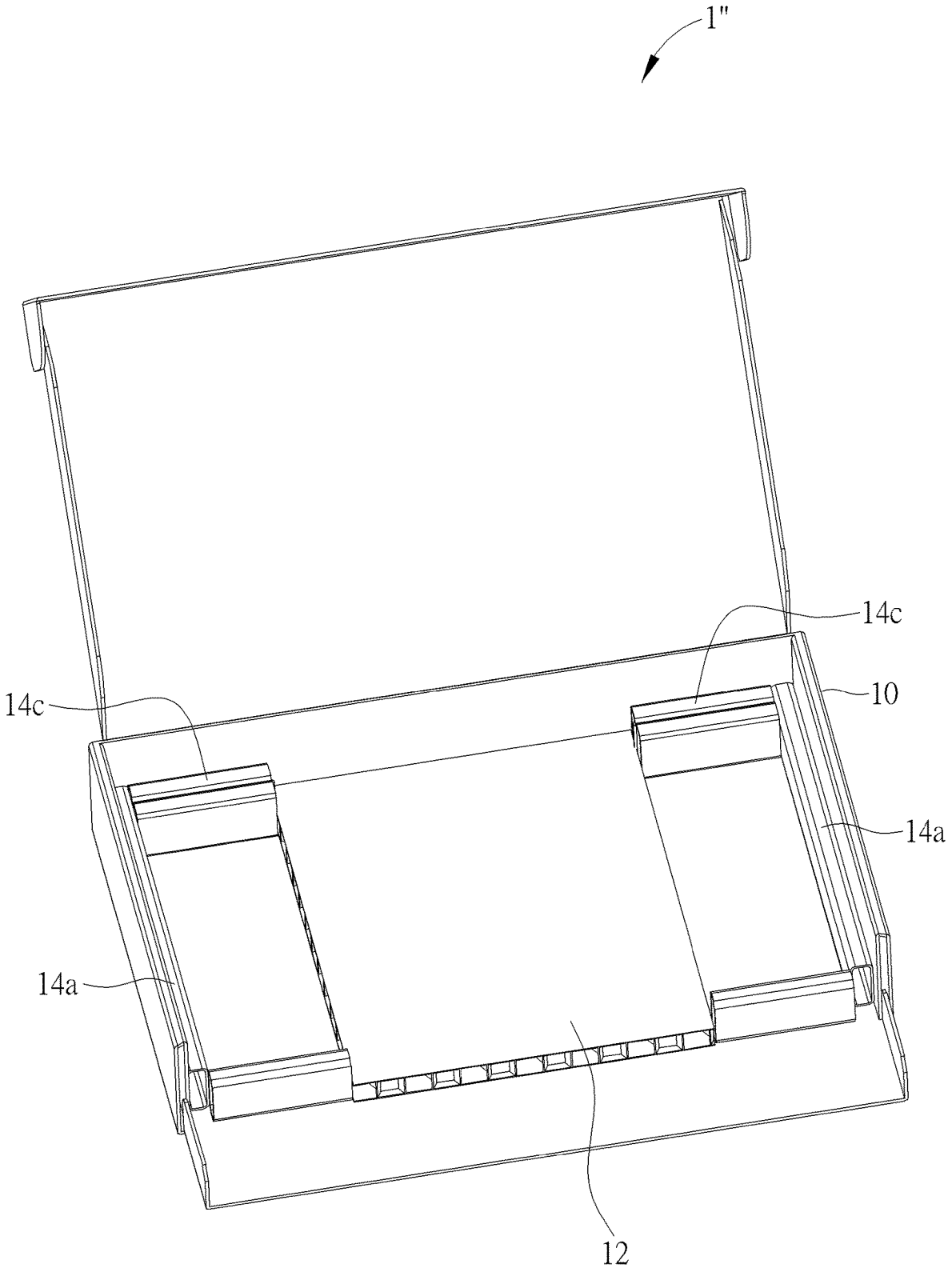
FIG. 13 is a perspective view illustrating a cushion package box according to another embodiment of the disclosure.

Referring to FIG. 13, FIG. 13 is a perspective view illustrating a cushion package box 1" according to another embodiment of the disclosure. As shown in FIG. 13, the at least one paper tube of the cushion package box 1' comprises two L-shaped paper tubes 14*a* and two double-layer paper tubes 14*c*. Each of the two L-shaped paper tubes 14*a* may be formed by bending a strip-shaped paper tube along a slot (like the slot 144 shown in FIG. 7) by 90 degrees. For further explanation, the paper tube 14 shown in FIG. 7 may be bent along the slot 144 by 90 degrees toward a direction opposite to the slot 144, so as to form the L-shaped paper tube 14*a* shown in FIG. 13. Each of the two double-layer paper tubes 14*c* may be formed by bending a strip-shaped paper tube along a slot (like the slot 144 shown in FIG. 7) by 180 degrees, so as to increase the strength of the paper tube. For further explanation, the paper tube 14 shown in FIG. 7 may be bent along the slot 144 by 180 degrees toward a direction opposite to the slot 144, so as to form the double-layer paper tubes 14*c* shown in FIG. 13. The two L-shaped paper tubes 14*a* are located at opposite sides of the box body 10, and the two double-layer paper tubes 14*c* respectively abut against the two L-shaped paper tubes 14*a*. As shown in FIG. 13, an edge (e.g. upper edge) of the first cushion member 12 is sandwiched in between the two double-layer paper tubes 14*c*, and another edge (e.g. lower edge) of the first cushion member 12 is sandwiched in between two ends of the two L-shaped paper tubes 14*a*. Accordingly, the first cushion member 12 can be positioned in the box body 10 stably.

Figure 14:
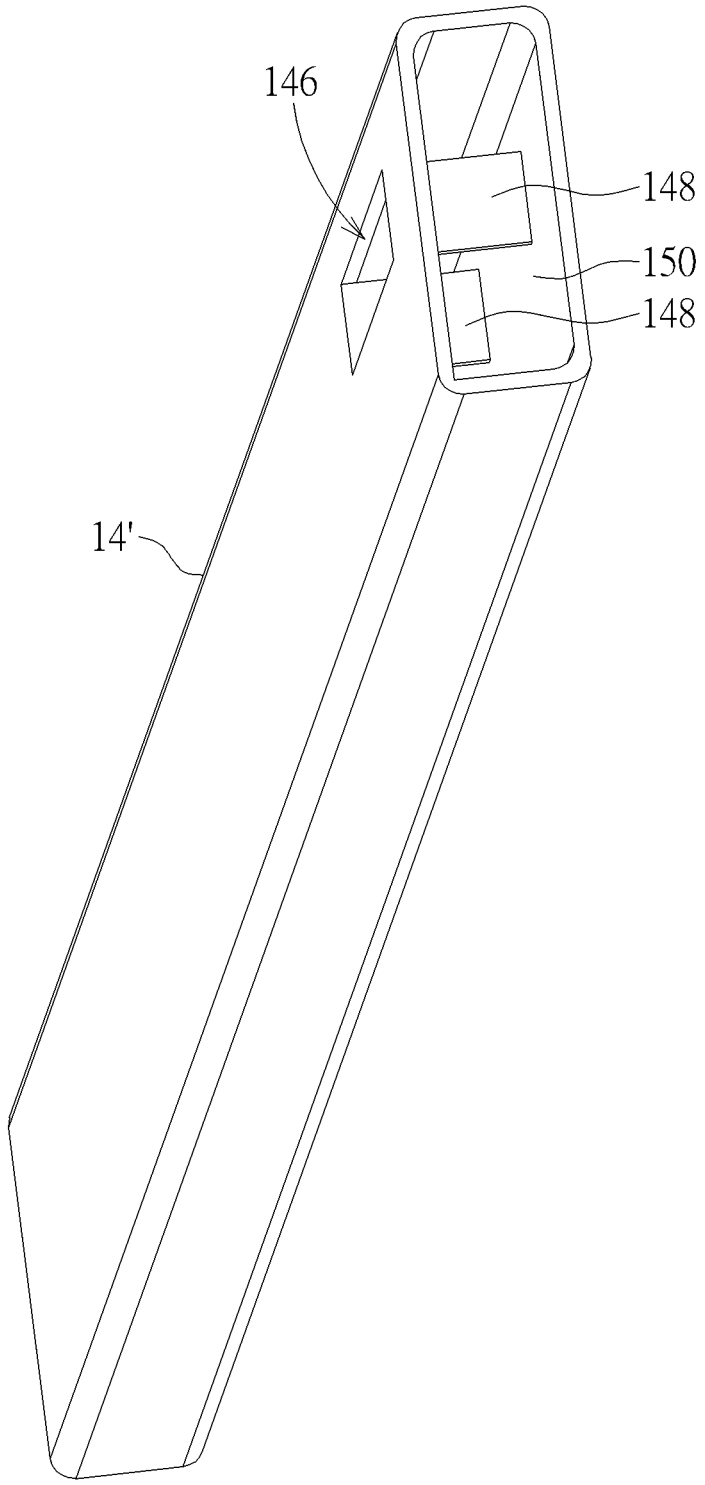
FIG. 14 is a perspective view illustrating a paper tube according to another embodiment of the disclosure.

Referring to FIG. 14, FIG. 14 is a perspective view illustrating a paper tube 14' according to another embodiment of the disclosure. As shown in FIG. 14, at least one reinforcing portion 148 may be bent from a side of the paper tube 14' to abut against an inner surface 150 of the paper tube 14' and form a through hole 146. In this embodiment, two reinforcing portions 148 are bent from a side of the paper tube 14' to abut against the inner surface 150 of the paper tube 14', but the disclosure is not so limited. When the paper tube 14' is disposed in the aforesaid box body 10, the through hole 146 may be used to accommodate a protruding structure (e.g. function key, etc.) of an electronic product. Furthermore, the reinforcing portion 148 increases the strength of the paper tube 14'.

In another embodiment of the disclosure, the aforesaid first cushion member 12 may have at least one recess or opening for accommodating a protruding structure (e.g. function key, etc.) and/or accessories of an electronic product.

In another embodiment of the disclosure, the aforesaid paper tube 14 may have at least one recess or opening for accommodating a protruding structure (e.g. function key, etc.) and/or accessories of an electronic product.

As mentioned in the above, the disclosure replaces the molded pulp and/or the corrugated paper of the prior art by the first cushion member with the porous structure and the paper tube, so as to reduce assembly materials of the cushion package box, reduce assembly cost, and improve assembly efficiency. Since the structure of the cushion package box is simplified, the disclosure can effectively avoid the problems such as improper assembly and lack of components due to manual assembly operation. Furthermore, the cushion abilities of the first cushion member with the porous structure and the paper tube are good, such that the disclosure can effectively improve the protection to the product. Moreover, the material characteristics of the first cushion member with the porous structure and the paper tube may reduce the cushion distance, such that the whole volume of the cushion package box may be further reduced, so as to increase the packing capacity of the cushion package box and reduce the transportation cost. In practical applications, the cushion package box of the disclosure may be used to pack an object (e.g. electronic product) to form the electronic product cushion package assembly.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A cushion package box comprising:

a box body;

a first cushion member disposed in the box body, the first cushion member having a porous structure, an opening direction of the porous structure being different from an opening direction of at least one paper tube; and the at least one paper tube disposed in the box body, the at least one paper tube being in contact with the first cushion member.

2. The cushion package box of claim 1, wherein the at least one paper tube surrounds the first cushion member.

3. The cushion package box of claim 1, wherein the at least one paper tube is disposed on the first cushion member.

4. The cushion package box of claim 1, wherein the first cushion member is a honeycomb board and the porous structure is honeycomb-shaped.

5. The cushion package box of claim 1, wherein the opening direction of the porous structure is perpendicular to the opening direction of the at least one paper tube.

6. The cushion package box of claim 1, wherein a number of the at least one paper tube is four, the four paper tubes are strip-shaped, and the four paper tubes are arranged to form a rectangle.

7. The cushion package box of claim 1, wherein a number of the at least one paper tube is one and the paper tube is bent to form a rectangle.

8. The cushion package box of claim 1, wherein a number of the at least one paper tube is two, one of the two paper tubes is bent to be U-shaped, the other one of the two paper tubes is strip-shaped, and the two paper tubes are arranged to form a rectangle.

9. The cushion package box of claim 1, wherein a number of the at least one paper tube is two, the two paper tubes are bent to be L-shaped, and the two paper tubes are arranged to form a rectangle.

10. The cushion package box of claim 1, further comprising a second cushion member disposed in the box body and located above the first cushion member.

11. The cushion package box of claim 1, wherein a cross section of a tube body of the at least one paper tube is rectangular, L-shaped or U-shaped.

12. The cushion package box of claim 1, wherein a tube body of the at least one paper tube has two cutting grooves and a reinforcing portion, the reinforcing portion is located between the two cutting grooves, and the reinforcing portion is located in the tube body when the tube body is bent.

13. The cushion package box of claim 1, wherein a tube body of the at least one paper tube has a slot, such that the at least one paper tube is able to be bent along the slot by 90 or 180 degrees.

14. The cushion package box of claim 1, wherein the first cushion member is a honeycomb board, the porous structure is honeycomb-shaped, the opening direction of the porous structure is perpendicular to a bottom surface of the box body, the opening direction of the at least one paper tube is parallel to the bottom surface of the box body, a number of the at least one paper tube is four, the four paper tubes are strip-shaped, and the four paper tubes are arranged to form a rectangle.

15. The cushion package box of claim 14, wherein the at least one paper tube surrounds the first cushion member, the cushion package box further comprises a second cushion member, and the second cushion member is disposed in the box body and located above the first cushion member.

16. The cushion package box of claim 1, wherein the at least one reinforcing portion is bent from a side of the at least one paper tube to abut against an inner surface of the at least one paper tube.

17. The cushion package box of claim 1, wherein the at least one paper tube comprises two L-shaped paper tubes, the two L-shaped paper tubes are located at opposite sides of the box body, and the first cushion member is sandwiched in between two ends of the two L-shaped paper tubes.

18. An electronic product cushion package assembly comprising:

a cushion package box comprising a box body, a first cushion member and at least one paper tube, the first cushion member being disposed in the box body, the first cushion member having a porous structure, an opening direction of the porous structure being different from an opening direction of the at least one paper tube, the at least one paper tube being disposed in the box body, the at least one paper tube being in contact with the first cushion member; and an electronic product disposed in the box body, the at least one paper tube surrounding the electronic product.

19. The electronic product cushion package assembly of claim 18, wherein the first cushion member is a honeycomb board, the porous structure is honeycomb-shaped, the opening direction of the porous structure is perpendicular to the opening direction of the at least one paper tube, a number of the at least one paper tube is four, the four paper tubes are strip-shaped, and the four paper tubes are arranged to form a rectangle.

20. The electronic product cushion package assembly of claim 19, wherein the at least one paper tube surrounds the first cushion member, the cushion package box further comprises a second cushion member, the second cushion member is disposed in the box body, and the electronic product is sandwiched in between the second cushion member, the first cushion member and the at least one paper tube.

* * * * *